United States Patent [19]

Dietlein

[11] 4,175,736

[45] Nov. 27, 1979

[54] SKI HOLDING SYSTEM

[76] Inventor: Robert W. Dietlien, 3040 Deer Run Rd., Carson City, Nev. 89701

[21] Appl. No.: 905,595

[22] Filed: May 15, 1978

[51] Int. Cl.[2] ..... A63C 11/04

[52] U.S. Cl. ..... 269/88; 269/296; 269/321 W; 280/11.37 T

[58] Field of Search ..... 280/11.37 C, 11.37 T, 280/11.37 A, 11.37 R; 269/321 W, 296, 88, 97

[56] References Cited

U.S. PATENT DOCUMENTS

| | | | |
|---|---|---|---|
| 3,826,482 | 7/1974 | Tourangeau | 269/321 W X |
| 3,854,712 | 12/1974 | McGee | 269/321 W X |
| 4,078,780 | 3/1978 | Schwarz | 269/296 X |
| 4,081,180 | 3/1978 | Munn | 269/321 W X |

FOREIGN PATENT DOCUMENTS

| | | | |
|---|---|---|---|
| 902633 | 12/1944 | France | 269/97 |
| 947469 | 1/1949 | France | 269/97 |

*Primary Examiner*—Joseph F. Peters, Jr.
*Assistant Examiner*—Milton L. Smith
*Attorney, Agent, or Firm*—William W. Haefliger

[57] ABSTRACT

Ski holding apparatus includes a pair of non-skid blocks to support a ski in different configurations. Also, a vise grips the ski between the blocks.

15 Claims, 9 Drawing Figures

30
36
50
40
41
37
38b
59
54
42
56
55
38a
42a
48
50
41
26a
7
8
20
8
7

20
30
36
37
38a
38
30
50
39
38b
54
59
55
51
52
9
9
40
48
41
41
42
26
42a
45
26a
44
42b
31
46

59
56a
56
60
61
55

52
38a
37
50
50
52
56
57
38
40
41
39
41
26
42a
26a
45
42
44
42b
46

SKI HOLDING SYSTEM

BACKGROUND OF THE INVENTION

This invention relates generally to ski servicing equipment, and more particularly concerns apparatus to hold a ski in different modes to enable "tuning" of the ski. "Tuning" refers to servicing such as filing the edges or bottom of a ski, or waxing the bottom surface, etc.

It frequently becomes necessary for skiers to have their skis serviced, as disclosed above, at ski shops. This is a time consuming and expensive procedure, and can seriously limit the time available for skiing due to work backlogs at such shops. There is, accordingly, a need for equipment which is easily usable by a skier at home or at the recreational area.

SUMMARY OF THE INVENTION

It is a major object of the invention to provide simple support equipment enabling a skier to tune his own skis, it merely requiring the availability of a table top to enable set-up of the equipment. As will be seen, the equipment basically comprises three items, one of which is a vise-like element to attach to a central portion of the ski, and the other two of which are special holders in the form of blocks which support opposite end portions of the ski.

With regard to the holders, they are alike, and each comprises:

(a) a block having first and second opposite sides, and opposite ends, (b) an elongated slot sunk in the block from the first side, the slot extending through the opposite ends, and (c) non-skid means carried by the block and exposed at the second side, (d) whereby a ski may be placed downwardly in the slot and retained in position by the block with the non-skid means at the second side engaged against a supporting surface.

As will be seen, the non-skid means may comprise buttons of non-skid material integral with the block; and like buttons may be located at the upper or first side of the block to support an inverted ski against movement, with the center of the ski gripped by the vise or clamp. Also, the slots have dimensions to edgewise support a ski inserted into the slots, in the manner to be described, and the blocks may be shifted about in very simple manner to accommodate to the cambered ski configuration in the two different support modes. Finally, the vise or clamp is specially configured in relation to a ski and to the blocks, to cooperate therewith in ski supporting modes, These and other objects and advantages of the invention, as well as the details of an illustrative embodiment, will be more fully understood from the following description and drawings, in which:

DRAWING DESCRIPTION

DETAILED DESCRIPTION

Figure 4:
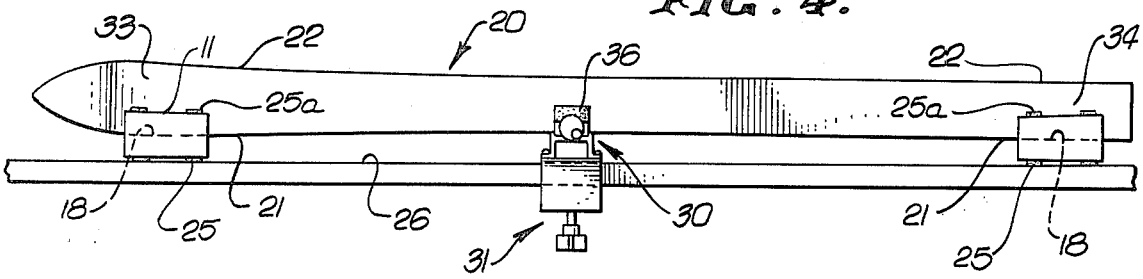
FIG. 4 is a side elevation on lines 4—4 of FIG. 3.
Figure 5:
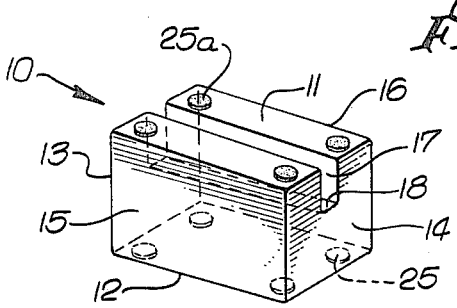
FIG. 5 is a perspective view of a ski holder block as used in FIGS. 1-4.
Figure 6:
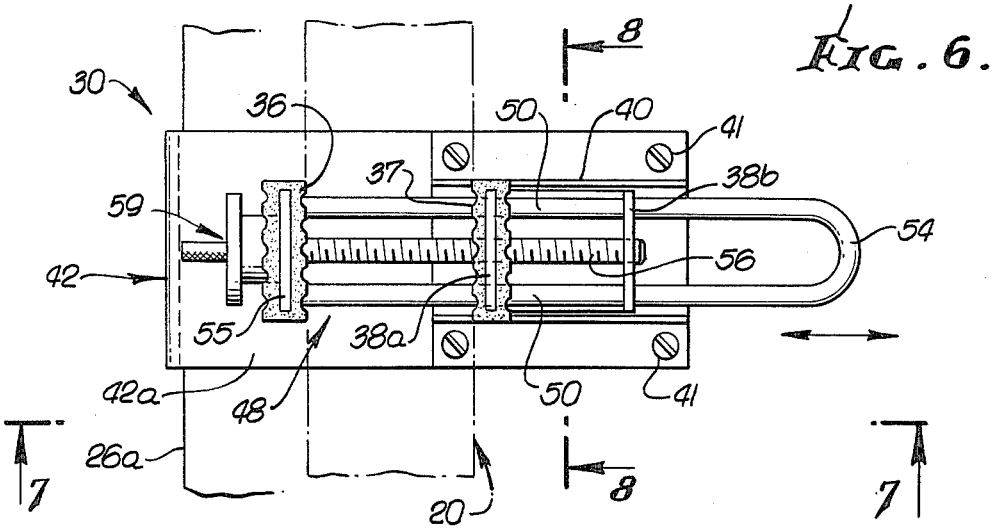
FIG. 6 is a top plan view of a ski holding clamp as used in FIGS. 1-4.
Figure 7:
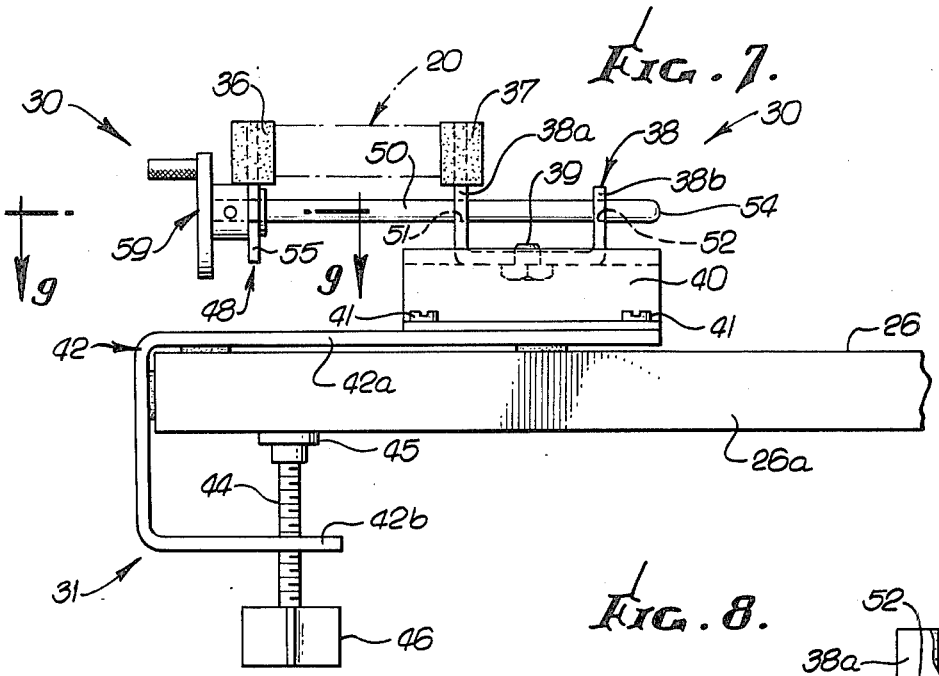
FIG. 7 is a side elevation on lines 7—7 of FIG. 6.
Figure 9:
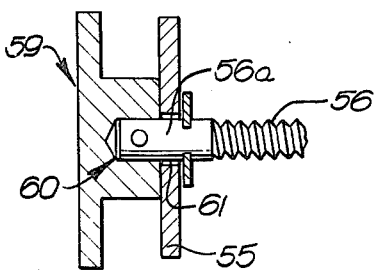
FIG. 9 is an enlarged section on lines 9—9 of FIG. 7.
Figure 8:
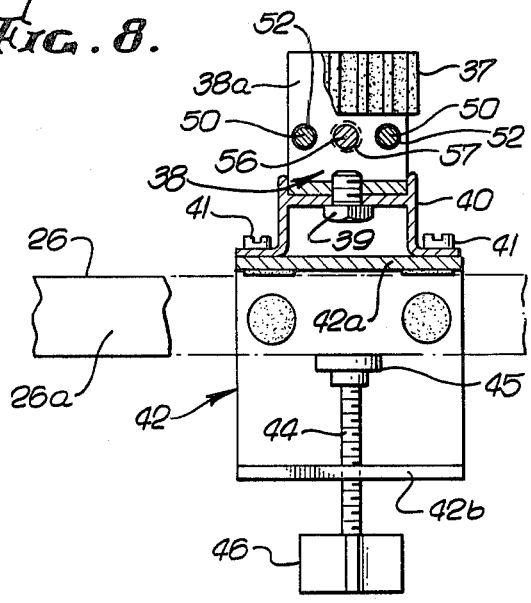
FIG. 8 is a section on lines 8—8 of FIG. 6.

Referring first to FIG. 5, a non-skid, ski holder is shown to comprise a block 10 having first and second opposite sides 11 and 12 and opposite ends 13 and 14. Sides 11 and 12 are typically the upper and lower sides as shown. In addition, the block has opposite side faces 15 and 16. See also FIGS. 1-4 showing these sides, faces and ends on each of two like blocks 10 used to support a ski 20 in two different support modes.

Figure 3:
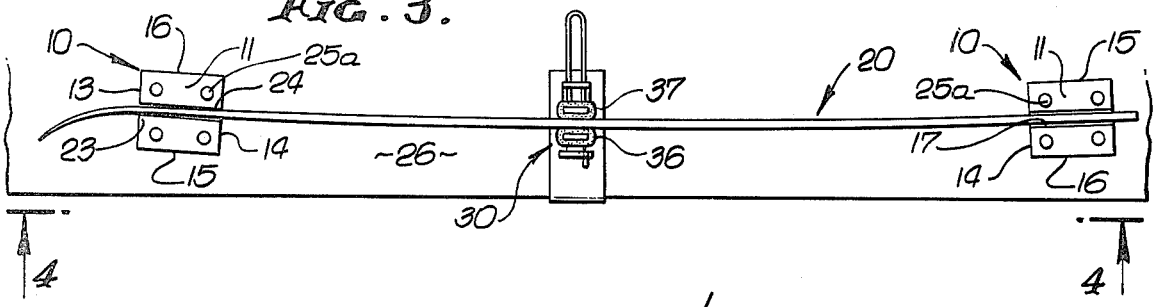
FIG. 3 is a top plan view of a ski supported in another mode, on apparatus incorporating the invention.

An elongated slot 17 is sunk downwardly in the block 10 from the first side 11, the slot extending through the opposite ends 13 and 14, whereby the ski edge 21 as shown in FIGS. 3 and 4 may be received edgewise downwardly in the slot to seat on the slot bottom wall 18. The depth of the slot is less than the ski width, so that the ski opposite edge 22 lies above the block, allowing that edge to be worked on, as for example filed as during "tuning" of the ski. Clearly, the ski may be reversed, so that edge 21 is upwardly exposed for treatment. The slot width is normally slightly larger than the ski thickness; however, the block can be shifted or canted to bring the slot slightly out of alignment with the plane of ski inserted portion, whereby the ski engages the slot opposite walls (as at 23 and 24 in FIG. 3) to firmly hold the ski in position.

Such shifting or canting of the block is accommodated by the provision of non-skid means carried by the block, and exposed at its first (upper) and second (lower) sides. As shown, the non-skid means may advantageously take the form of buttons 25 of non-skid material integral with the block, as at the four positions on said lower side, a shown. Such buttons may consist of relatively soft rubber, or suitable plastic material. Accordingly, when the block is placed on a table or other suurface 26, it positively resists shifting in directions parallel to the table, and it also resists overturning. The block may be wooden, or may consist of other material. The depth of the slot may be about $1\frac{3}{8}$ inches and its width about $\frac{1}{2}$ inch, for example.

As shown in FIGS. 3-4 two such blocks are shown edgewise supporting a ski, the blocks adjustably positioned on surface 26 to accommodate to the ski camber, i.e., the blocks are spaced apart in the general direction of their longitudinal slots; however, the slots in the two blocks are out of alignment. Such shifting or positioning of the blocks is easily accomplished as by lifting them vertically away from the table, and then setting them down where desired. Note the clamp means 30, in FIGS. 1-4, between the blocks, to positively grip the ski central portion, such means also being clamped to the table, at 31.

Figure 1:
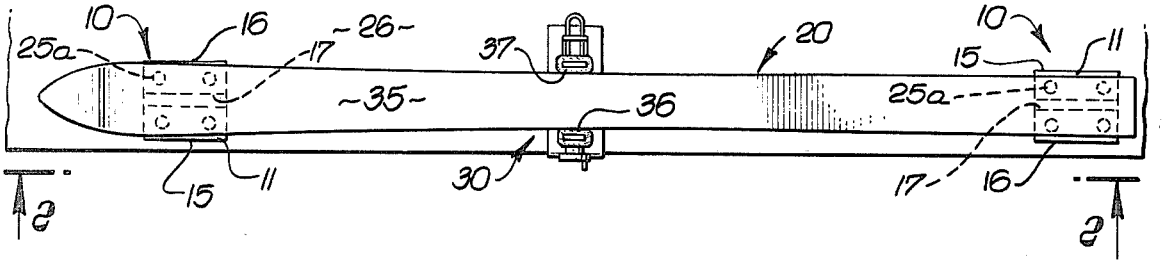
FIG. 1 is a plan view of a ski supported, in one mode, on apparatus incorporating the invention.
Figure 2:
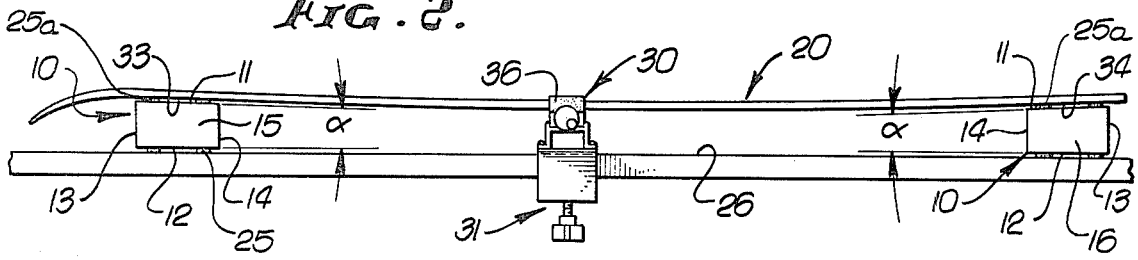
FIG. 2 is a side elevation on lines 2—2 of FIG. 1.

A further feature of each holder block resides in the provision of relative taper angularity as between opposite sides 11 and 12. Such angularly appears in FIG. 2 as defined by angle $\alpha$ for each block, the two blocks arranged so that they taper generally toward another. Accordingly, with lower sides 12 extending generally horizontally parallel to table surface 26, the two upper sides 11 are inclined from horizontal, and toward one another to extend generally parallel to the supported surface extents 33 and 34 of the ski, with camber as shown. Non-skid means is also carried by each block and exposed at the first or upper side 11, to support the ski face adjacent thereto, in non-skid relation. FIGS. 1 and 2 show this mode, with buttons 25*a* of non-skid material on the blocks supporting the ski. The ski bottom, indicated at 35, is then upwardly exposed for filing or tuning. The clamp means 30, in this mode, firmly engages opposite edges 21 and 22 of the ski, at its central region. Also, in this mode, the slots 17 of the blocks are normally in alignment; accordingly, the blocks are shifted somewhat, relative to one another, as between the support modes of FIGS. 1 and 3.

Referring now to FIGS. 6–9, the clamp means 30 is shown to include a vise arrangement with a pair of ski engaging clamp pads 36 and 37 which are laterally spaced apart. Support means fixedly supporting one pad includes a U-shaped strap 38 attached at 39 to bracket 40, the latter attached via bolts 41 to upper leg 42*a* of C-shaped base 42. Pad 37 is carried by upright strap arm 38*a*. Base leg 42*a* lays on surface 26 of table 26*a*; base leg 42*b* extends beneath the table, and adjustable tightening screw 44 interfits leg 42*b* and carries a clamp pad 45 tightenable against the underside of the table. Note tightening knob 46.

An adjustable carrier 48 supports the other ski clamping pad 36 for lateral movement toward and away from pad 37. The two pads may for example consist of hard rubber. The carrier 48 may advantageously include two laterally extending guide means such as parallel rods 50 having guided interfit with the support strap 38 as at bearing openings 51 and 52 associated with arm 38*a* and arm 38*b*. The ends of the rods are interconnected via U-shaped turn 54; also, the opposite ends of the rods are connected to carrier upright 55 which also supports pad 36. A lead screw 56 extends laterally between the two rods, and threadably engages the arm element 38*a*, as at 57, whereby when the screw is rotated, the carrier is advanced or retracted, laterally, depending upon the direction of screw rotation. A handle 59 is connected at 60 to the rod to rotate same, as is clear from FIGS. 7 and 9. The end 56*a* of the screw has bearing interfit at 61 with upright 55. Screw 56 may have double lead, for rapid movement.

It will be noted that the blocks are of a height to support a ski (as in FIG. 2) with slight downward pressure against the non-skid means, the vise holding the ski down.

I claim:

1. A non-skid ski holder, comprising (a) a block having first and second opposite sides, and opposite ends, (b) a longitudinally elongated slot sunk in the block from said first side, the slot extending through said opposite ends, said first and second sides extending in the direction of said slot, and with relative taper angularity corresponding to ski camber, and (c) non-skid means carried by the block and exposed at both said first and second sides, said non-skid means having generally longitudinally spaced portions, (d) whereby a ski may be placed downwardly in said slot and retained in position by the block with said non-skid means at said second side engaged against a supporting surface, and a ski upper surface may alternatively be placed downwardly on the non-skid means on said first side.

2. The holder of claim 1 wherein said non-skid means comprise buttons of non-skid material integral with the block.

3. The holder of claim 1 wherein the slot has a width which is about the same as the thickness of a ski, and a depth which is less than the width of a ski.

4. The holder of claim 3 in combination with a ski inserted into said slot.

5. In combination, a pair of holders each having a construction as defined in claim 1, said holder slots extending in the direction of a cambered ski, and said holders spaced apart in the general direction of said slots to receive a ski therein.

6. The holder combination of claim 5 in combination with a ski inserted edgewise downwardly into said slots, the depths of the slots being less than the ski width, so that the ski has an upper edge above the blocks.

7. The holder and ski combination of claim 6 including means between the blocks gripping a mid-portion of said ski, in fixed position.

8. The holder combination of claim 5 including means between the blocks for releasably gripping and holding a mid-portion of the ski in fixed position.

9. In combination (a) a pair of holders each having a construction as defined in claim 1, and (b) vise means between the blocks for releasably gripping and holding a mid-portion of the ski in fixed position, the relative taper of said block sides being generally toward the vise means.

10. The combination of claim 9 including said ski inserted into said slots of the blocks and gripped by said vise means.

11. The combination of claim 9 including the ski with its opposite edges gripped by the vise means and the snow engaging bottom surface of the ski being upwardly exposed.

12. The combination of claim 11 wherein said vise means includes a pair of ski engaging clamp pads which are laterally spaced apart, a support means fixedly supporting one of said pads, and an adjustable carrier supporting the other pad for lateral movement toward and away from said one pad.

13. The combination of claim 12 including a lead screw which extends laterally and threadably engages a first element fixedly supported on said support means, and which is also rotatably connected to said carrier.

14. The combination of claim 13 wherein the carrier includes laterally extending guide means having guided engagement with said support means at two laterally spaced locations.

15. The combination of claim 12 including another clamp carried by said support means to clamp to a table having an upper surface which supports said blocks.

* * * * *